US012077963B1

(12) United States Patent
Ren et al.

(10) Patent No.: US 12,077,963 B1
(45) Date of Patent: Sep. 3, 2024

(54) REINFORCED CONCRETE COMPOSITE BEAM STRUCTURE BASED ON PRECAST CONCRETE BEAM-SLAB INTEGRATED UNITS AND CONSTRUCTION METHOD THEREOF

(71) Applicant: Fujian Construction Engineering Prefabricated Building Research Institute Co., Ltd, Fuzhou (CN)

(72) Inventors: Yu Ren, Fuzhou (CN); Siyuan Chi, Fuzhou (CN); Yajie Zhang, Fuzhou (CN); Yujun Wu, Fuzhou (CN)

(73) Assignee: Fujian Construction Engineering Prefabricated Building Research Institute Co., Ltd, Fuzhou (CN)

( * ) Notice: Subject to any disclaimer, the term of this patent is extended or adjusted under 35 U.S.C. 154(b) by 0 days.

(21) Appl. No.: 18/434,852

(22) Filed: Feb. 7, 2024

(30) Foreign Application Priority Data

Jul. 29, 2023 (CN) ..... 202310942068.0

(51) Int. Cl.
*E04C 5/06* (2006.01)
*E04C 5/16* (2006.01)

(52) U.S. Cl.
CPC ..... *E04C 5/0609* (2013.01); *E04C 5/064* (2013.01); *E04C 5/166* (2013.01)

(58) Field of Classification Search
CPC ..... E04C 5/0609; E04C 5/064; E04C 5/166
(Continued)

(56) References Cited

U.S. PATENT DOCUMENTS 1,512,763 A * 10/1924 Holmgreen ..... E04C 5/16 52/669
1,727,147 A * 9/1929 Weston ..... E04C 5/064 52/649.1

(Continued)

FOREIGN PATENT DOCUMENTS

CN 205077686 U * 3/2016
CN 113123516 A 7/2021

(Continued)

OTHER PUBLICATIONS

CN 113123516 Machine Translation (Year: 2024).*

(Continued)

*Primary Examiner* — James M Ference
(74) *Attorney, Agent, or Firm* — Zhigang Ma

(57) ABSTRACT

A reinforced concrete composite beam structure based on precast concrete beam-slab integrated units include rib beams and rebar cages; stirrups in the rib beams are closed stirrups; upper parts of the closed stirrups in each rib beam are extended from the rib beam and taken as connecting rings; the rebar cages are disposed on upper parts of two connected rib beams; the connecting rings are lapped with beam surface closed stirrups to form the reinforced concrete composite beam structure with the rib beams after casting concrete. Its construction method includes: installing the precast concrete beam-slab integrated units; hoisting the rebar cages on the rib beams to tie two corresponding connecting rings with the corresponding beam surface closed stirrup in a staggered and overlapped manner; and casting concrete to submerge the rebar cages. A form of the closed stirrups is proposed when rib width of the rib beams is small.

7 Claims, 8 Drawing Sheets

(58) Field of Classification Search
USPC ..... 52/649.1
See application file for complete search history.

(56) References Cited

U.S. PATENT DOCUMENTS

| | | | | | |
|---|---|---|---|---|---|
| 1,814,007 | A * | 7/1931 | Neely | E04C 5/18 | 52/689 |
| 5,090,172 | A * | 2/1992 | Chana | E04C 5/0645 | 52/252 |
| 5,317,846 | A * | 6/1994 | Michlovic | H02G 3/283 | 52/250 |
| 5,913,341 | A * | 6/1999 | Jones | E04G 21/123 | 52/750 |
| 9,518,388 | B1 * | 12/2016 | Wang | E04B 1/161 | |
| 2005/0257482 | A1 * | 11/2005 | Galluccio | E04C 5/0618 | 52/649.2 |
| 2006/0059804 | A1 * | 3/2006 | Brown | E04C 5/0645 | 52/223.13 |
| 2022/0268024 | A1 * | 8/2022 | Yin | E04C 5/0622 | |

FOREIGN PATENT DOCUMENTS

| | | | | |
|---|---|---|---|---|
| CN | 214195283 | U | 9/2021 | |
| DE | 20308367 | U1 * | 9/2003 | E04B 1/215 |
| DE | 202004018655 | U1 * | 5/2005 | E04B 5/046 |
| EP | 0345620 | A2 * | 12/1989 | |
| FR | 2925088 | A1 * | 6/2009 | E04B 5/29 |
| WO | WO-2011062465 | A2 * | 5/2011 | E04B 5/23 |

OTHER PUBLICATIONS

CNIPA, Notification of a First Office Action for CN202310942068.0, Sep. 6, 2023.

Fujian Construction Engineering Prefabricated Building Research Institute Co., Ltd (Applicant), Reply to Notification of First Office Action for CN202310942068.0, w/ (allowed) replacement claims, Sep. 15, 2023.

CNIPA, Notification to grant patent right for invention in CN202310942068.0, Oct. 7, 2023.

* cited by examiner

| Number | Specimen number | *H* (mm) | *L* (mm) |
|---|---|---|---|
| 1 | RCJ | 3000 | 3000 |
| 2 | PCJ | 3000 | 3000 |
| 3 | PDCJ | 3000 | 3000 |

(b) specimen PCJ (c) specimen PCDJ

REINFORCED CONCRETE COMPOSITE BEAM STRUCTURE BASED ON PRECAST CONCRETE BEAM-SLAB INTEGRATED UNITS AND CONSTRUCTION METHOD THEREOF

TECHNICAL FIELD

The disclosure relates to the field of construction technology, and more particularly to a reinforced concrete composite beam structure based on precast concrete beam-slab integrated units and its construction method.

BACKGROUND

A formwork support system is usually required during a construction phase of prefabricated concrete buildings when the prefabricated concrete buildings use composite floor slabs and precast reinforced concrete composite beams. However, the formwork support system is complex and expensive when a floor height is large.

A Chinese patent with publication No.: CN113123516A proposes a beam-slab integrated precast concrete structure and construction method, which realizes an on-site construction of precast concrete structures without bracing and molding, and can significantly accelerate construction speeds with lower on-site construction cost.

According to above patent as well as other prior art, stirrups in rib beams mostly used are open stirrups, the open stirrups are U-shaped, and ends of each of the open stirrups are bent to form a crook, thereby to enhance connection strength with concrete. The open stirrups are coordinated with rebar caps in upper parts of beams, and the concrete is cast afterward to complete the construction of the precast concrete structure.

However, if rib width of the rib beams is small, no opening can be formed between two bent ends of rebars when ends of the rebars on left and right sides of the open stirrup are bent due to the rebars must meet a minimum bending radius, which will affect beam surface longitudinal rebars being disposed into the open stirrups.

Therefore, to guarantee feasibility of the construction of the precast concrete structure, there are two methods at present: either ensuring that the rib width of the rib beams is not too small, or adjusting diameters of the rebars corresponding to the open stirrups, but both methods limit practical applications. If neither condition of the methods can be met, it is also considered to pull apart exposed parts of the open stirrups after the construction of the precast concrete structure is completed; after the beam surface longitudinal rebars are disposed in place, the exposed parts of the open stirrups can be reset, which is of poor workmanship and affects construction schedule.

SUMMARY

The disclosure provides a reinforced concrete composite beam structure based on precast concrete beam-slab integrated units and its construction method, which proposes closed stirrups, a type of stirrups in each rib beam, when rib width of rib beams of the precast concrete beam-slab integrated units is small, the closed stirrups can be better connected with rebar cages, and realize unification of seismic performance with convenience of on-site installation.

The disclosure provides the reinforced concrete composite beam structure based on the precast concrete beam-slab integrated units, includes the rib beams of the precast concrete beam-slab integrated units, and the rebar cages. Each of the rib beams includes: rebars, and stirrups in the rebars are the closed stirrups. Upper parts of the closed stirrups in each rib beam are extended from the rib beam and taken as connecting rings connected to the rebar cages, width of the connecting rings is gradually reduced from bottom to top to define rebar-placed areas outside the connecting rings, and a top of each connecting ring is bent to form a curved section. The rebar cages include: beam surface longitudinal rebars and beam surface closed stirrups connected to the beam surface longitudinal rebars. The rebar cages are disposed on upper parts of two rib beams connected to each other, the beam surface longitudinal rebars are disposed in the rebars-placed areas outside the connecting rings, two corresponding connecting rings in the two rib beams are overlapped with a corresponding beam surface closed stirrup in a staggered manner when the rebar cages are disposed in place. The beam surface closed stirrups are lapped with the closed stirrups in a staggered manner to form the reinforced concrete composite beam structure with the rib beams after casting concrete.

The construction method of the reinforced concrete composite beam structure based on the precast concrete beam-slab integrated units includes following steps S1, S2 and S3.

S1, the precast concrete beam-slab integrated units are disposed over precast reinforced concrete composite frame beams, the rib beams of the precast concrete beam-slab integrated units are supported on the precast reinforced concrete composite frame beams.

S2, multiple rebar cages are sequentially hoisted along an extension direction of the rib beams, thereby the two corresponding connecting rings in two connected rib beams are tied with the corresponding beam surface closed stirrup in a staggered and overlapped manner, and it should be ensured that the beam surface longitudinal rebars of the rebar cages are vertically disposed in the rebars-placed areas of the closed stirrups.

S3, topping concrete is casted and submerges the rebar cages.

The beneficial effects of the disclosure compared to related art are as follows.

1. Design of the closed stirrups in the disclosure replaces design of end hooks of open stirrups in the related art, and when the closed stirrups are applied to the rib beams with small width, the rebars-placed areas can be defined for the beam surface longitudinal rebars disposed in the rebar cages; although the beam surface longitudinal rebars are not disposed inside the closed stirrups, the design of the closed stirrups still ensures integrality and connection strength between the closed stirrups and the rebar cages, and realizes unification of seismic performance with processability of the reinforced concrete composite beam structure finalized.

2. At the same time, to improve efficiency of on-site construction, the closed stirrups are connected with the rebar cages at the precast reinforced concrete composite beams, installation time of rebars in a rear casting area of the rib beams can be shortened to ¼ of the installation time in the related art.

Figure 1:
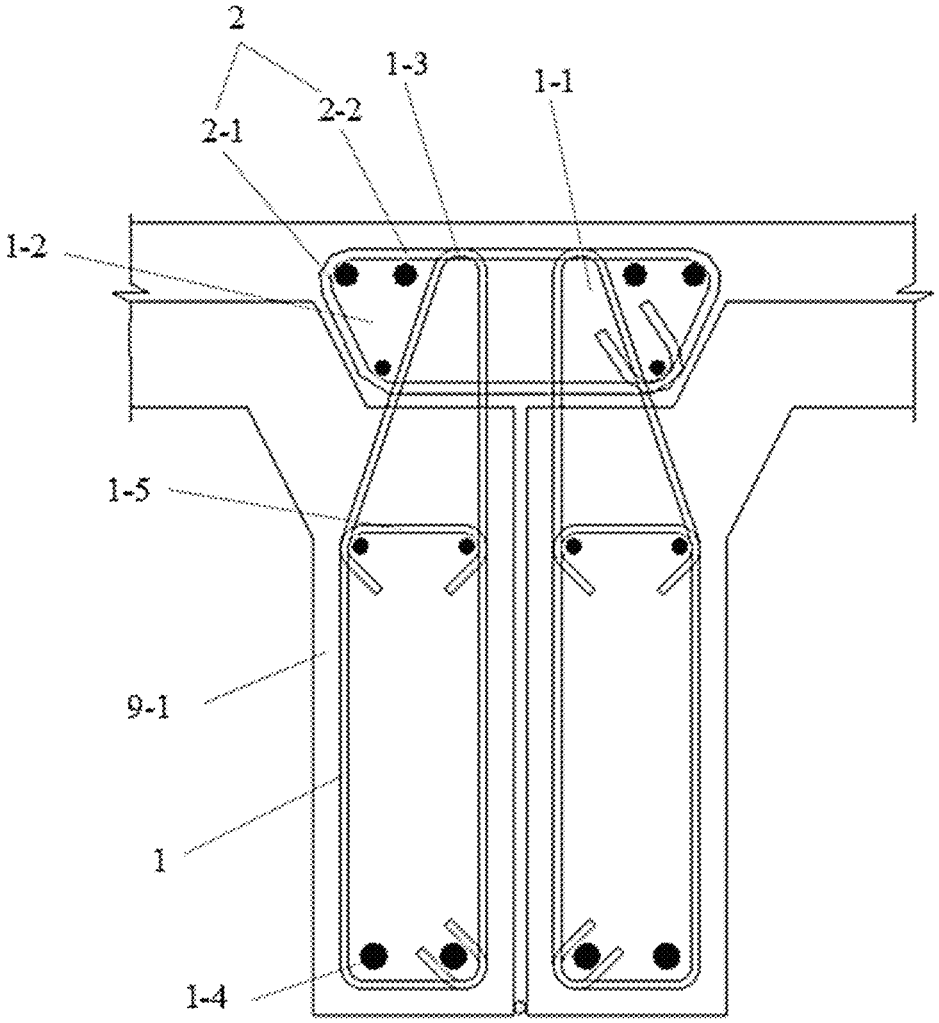
FIG. 1 illustrates a schematic diagram of a connection structure in the precast concrete beam-slab integrated units.
Figure 2:
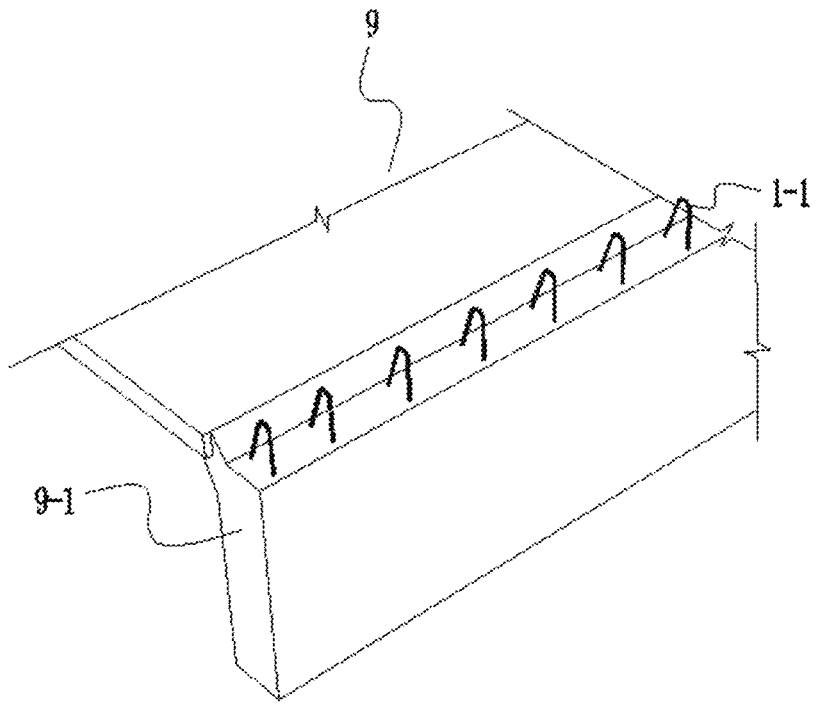
FIG. 2 illustrates a schematic diagram of a rib beam area in the precast concrete beam-slab integrated unit.
Figure 3:
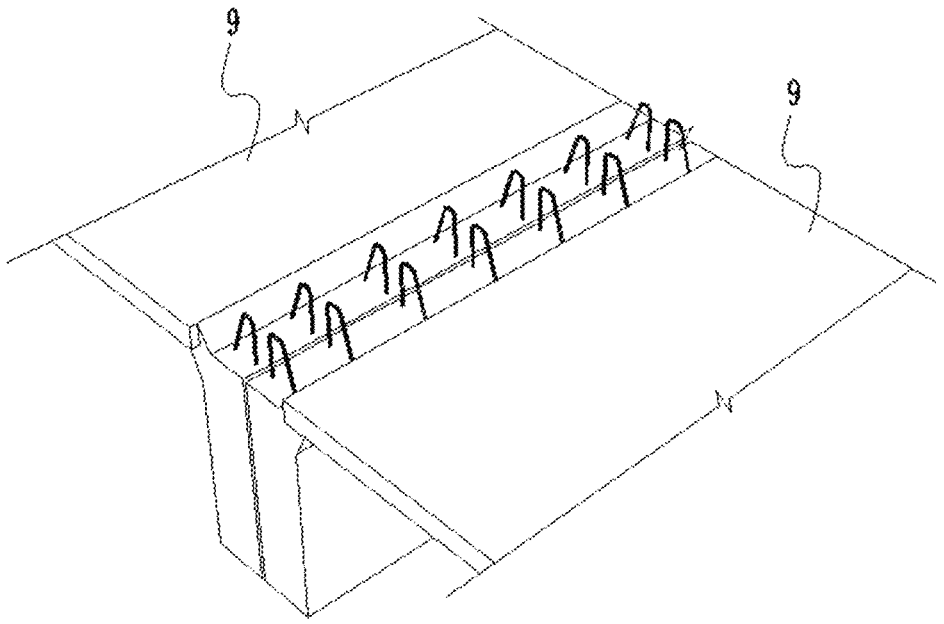
FIG. 3 illustrates a schematic structure diagram of two connected precast concrete beam-slab integrated units.
Figure 4:
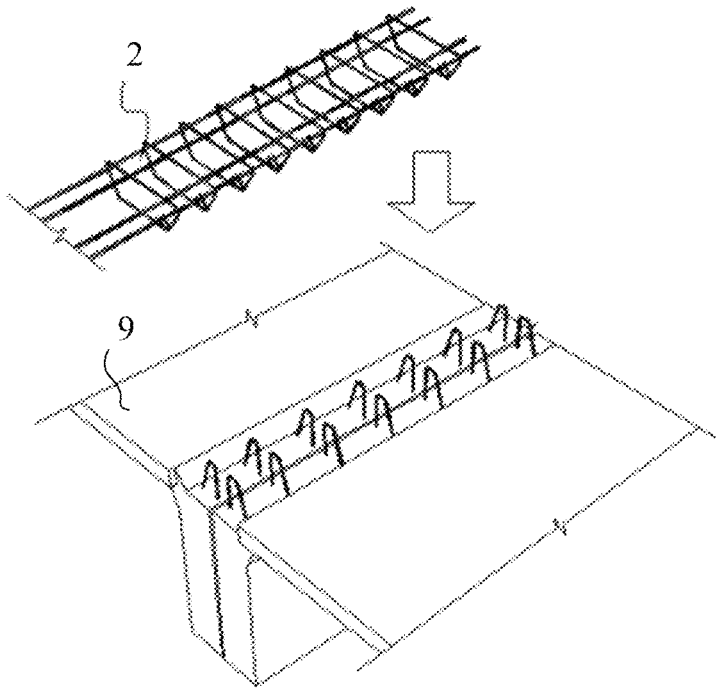
FIG. 4 illustrates a schematic diagram of the rebar cages hoisted to the connecting rings of the precast concrete beam-slab integrated units.
Figure 5:
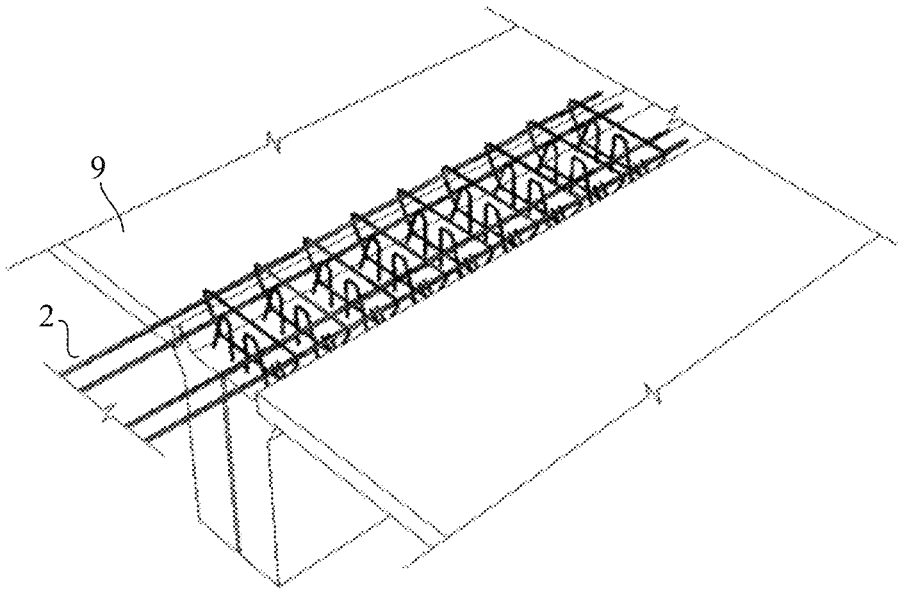
FIG. 5 illustrates a schematic structure diagram of the rebar cages hoisted in place.

Description of reference numerals: 1: closed stirrup; 1-1: connecting ring; 1-2: rebar-placed area; 1-3: curved section; 1-4: longitudinal rebar; 1-5: connecting hook; 2: rebar cage; 2-1: beam surface longitudinal rebar; 2-2: beam surface closed stirrup; 9: precast concrete beam-slab integrated unit; 9-1: rib beam.

DETAILED DESCRIPTION OF EMBODIMENTS

The disclosure is described clearly below in conjunction with the attached drawings.

Referring to FIG. 1, a reinforced concrete composite beam structure based on precast concrete beam-slab integrated units, includes rib beams 9-1 of precast concrete beam-slab integrated units 9, and rebar cages 2.

Each of the rib beams 9-1 includes: rebars, and stirrups in the rebars are closed stirrups 1.

Upper parts of the closed stirrups 1 in each of the rib beams 9-1 are extended from the rib beam 9-1 and taken as connecting rings 1-1 connected to the rebar cages 2, width of each connecting ring 1-1 is gradually reduced from bottom to top to define a rebar-placed area 1-2 outside each connecting ring 1-1, and a top of each connecting ring 1-1 is bent to form a curved section 1-3.

The rebar cages 2 include: beam surface longitudinal rebars 2-1 and beam surface closed stirrups 2-2 connected to the beam surface longitudinal rebars 2-1.

The rebar cages 2 are vertically placed into upper parts of two rib beams 9-1 connected to each other, that is, the rebar cages 2 are disposed on the upper parts of the two rib beams 9-1 connected to each other, the beam surface longitudinal rebars 2-1 are vertically placed into the rebars-placed areas 1-2 outside the connecting rings 1-1, that is, the beam surface longitudinal rebars 2-1 are disposed in the rebars-placed areas 1-2 outside the connecting rings 1-1, two corresponding connecting rings 1-1 in the two rib beams 9-1 are overlapped with a corresponding beam surface closed stirrup 2-2 in a staggered manner when the rebar cages 2 are disposed in place.

The beam surface closed stirrups 2-2 are lapped with the closed stirrups 1 in a staggered manner to form the reinforced concrete composite beam structure with the rib beams 9-1 after casting concrete.

The closed stirrups 1 are formed by bending rebars, a bottom of each closed stirrup is closed by two bent and overlapped curved hooks. The connecting rings 1-1 are extended from the rib beams 9-1 to connect with the rebar cages 2. The top of each connecting ring 1-1 is bent to form the curved section 1-3 equivalent to a bent section at a top of a conventional open stirrup, thereby to improve strength of connection with rear casting concrete.

The rebars include longitudinal rebars 1-4, and ones of the longitudinal rebars 1-4 are disposed inside a corresponding one of the closed stirrups 1 and connected to the corresponding closed stirrup 1.

The rebars further include connecting hooks 1-5, two ends of each connecting hook 1-5 are bent and connected to a corresponding longitudinal rebars 1-4.

The rib beam longitudinal rebars 1-4 and the connecting hooks 1-5 are mainly to improve integrity and strength of the rebars.

It is considered that the final effect is a part of the closed stirrup 1 extending out of the rib beam 91, that is, the width of the connecting ring 1-1 is gradually reduced from the bottom to the top. Therefore, each closed stirrup 1 is in a right-angled trapezoidal shape, and an acute angle area of each closed stirrup 1 is extended from the rib beam 9-1.

Referring to FIG. 1, each closed stirrup 1 has the right-angled trapezoidal shape in which a slant side is near a flat slab side of the precast concrete beam-slab integrated unit, thereby a double ring structure formed by the two corresponding connecting rings 1-1 has the rebar-placed areas 1-2 on two sides of the double ring structure, when the two rib beams 9-1 are disposed in place. The corresponding beam surface closed stirrup 2-2 has a shape of isosceles trapezoid with a top base longer than a bottom base, and the beam surface longitudinal rebars 2-1 are distributed on two sides of the beam surface closed stirrup 2-2. The beam surface longitudinal rebars 2-1 are disposed in the rebars-placed areas, at the same time, the beam surface closed stirrups 2-2 are lapped with the closed stirrups 1 in a staggered manner to ensure the seismic performance and the integrality of connection between the rebars and the rebar cages 2.

A construction method of the reinforced concrete composite beam structure based on the precast concrete beam-slab integrated units includes the following steps S1, S2 and S3.

S1, the precast concrete beam-slab integrated units 9 are disposed over the precast reinforced concrete composite frame beam, the rib beams 9-1 of the precast concrete beam-slab integrated units 9 are supported on the precast reinforced concrete composite frame beams.

S2, multiple rebar cages 2 are sequentially hoisted along the extension direction of the rib beams 9-1, thereby the two corresponding connecting rings 1-1 are tied with the corresponding beam surface closed stirrup 2-2 in a staggered and overlapped manner, and it should be ensured that the beam surface longitudinal rebars 2-1 of the rebar cages 2 are vertically disposed in the rebars-placed areas 1-2 of the closed stirrups 1.

S3, topping concrete is casted and submerges the rebar cages 2.

A construction method and structure in the step S1 are same as a published construction method and structure in a Chinese patent with publication NO.: CN113123516A. Therefore, the construction method and the structure in the step S1 are not be described.

Any two adjacent rebar cages 2 in the step S2 are connected by welding or lapping/tying ends of the beam surface closed stirrups 2-1.

If necessary, rebar meshes can be disposed on the rebar cages 2 and the rebar meshes are welded to the beam surface closed stirrups 2-2.

Considering cost and test effects, each closed stirrup 1 has the shape of the right-angle trapezoid, in which the slant side is near the flat slab side of the precast concrete beam-slab integrated unit; at the same time, the test effects are best when each beam surface closed stirrup 2-2 of the rebar cages 2 has a shape of an inverted isosceles trapezoid. It is convenient for the beam surface longitudinal rebars 2-1 to be disposed in the rebar-placed areas 1-2, and it also ensures connection effects between the two corresponding connecting rings 1-1 and the corresponding beam surface closed stirrup 2-2. Correspondingly, an inverted isosceles trapezoidal groove is disposed in an area with the connecting rings 1-1 in each ribbed beam 9-1 to dispose the beam surface closed stirrups 2-2. Of course, shapes of the beam surface closed stirrups can also be rectangular.

Compared to the related art, the disclosure has the beam surface longitudinal rebars 2-1 disposed outside rather than inside the closed stirrups 1, however, according to test data, there is no difference in overall performance between the disclosure and the related art.

To further verify the connection strength in the disclosure, a full-scale test of beam-column joints is conducted on the structure illustrated in FIG. 1 and a beam structure in the related art.

Cyclic loading tests are conducted on full-scale specimens of cast-in-place beam-column joints, conventional reinforced concrete composite beam-column joints and beam-slab integrated beam-column joints. The seismic performance of three beam-column joints is investigated and compared in terms of bearing capacity, deformation capacity, and damage modes by low-frequency cyclic loading tests.

Figure 6:
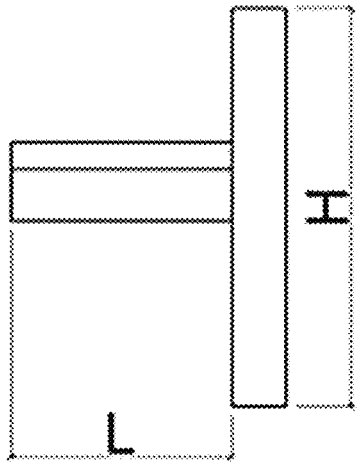
FIG. 6 illustrates a schematic diagram of a list of joints cross-sectional size of columns and beams.

Here cross-sections of columns of the joints are limited to 400×400 and cross-sections of beams of the joints are limited to 300×600 and joints dimensions are illustrated in FIG. 6.

Figure 7:
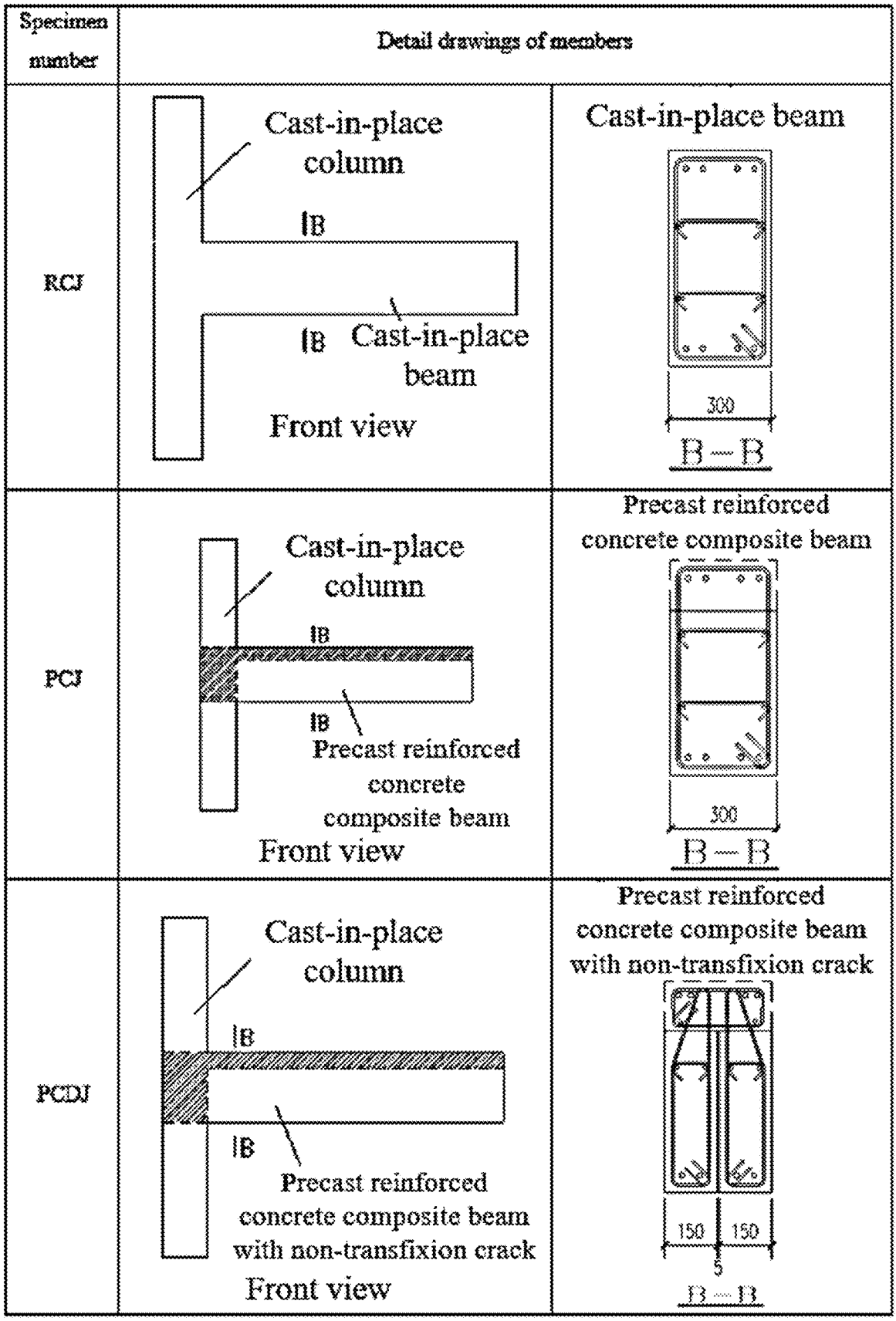
FIG. 7 illustrates a schematic diagram of a list of specimen structures with specimen numbers.

The three beam-column joints include a cast-in-place beam specimen with a specimen number RCJ, a conventional reinforced concrete composite beam specimen with a specimen number PCJ, and a new prefabricated joint specimen with a specimen number PCDJ described in the disclosure. Details are shown in FIG. 7.

Figure 8:
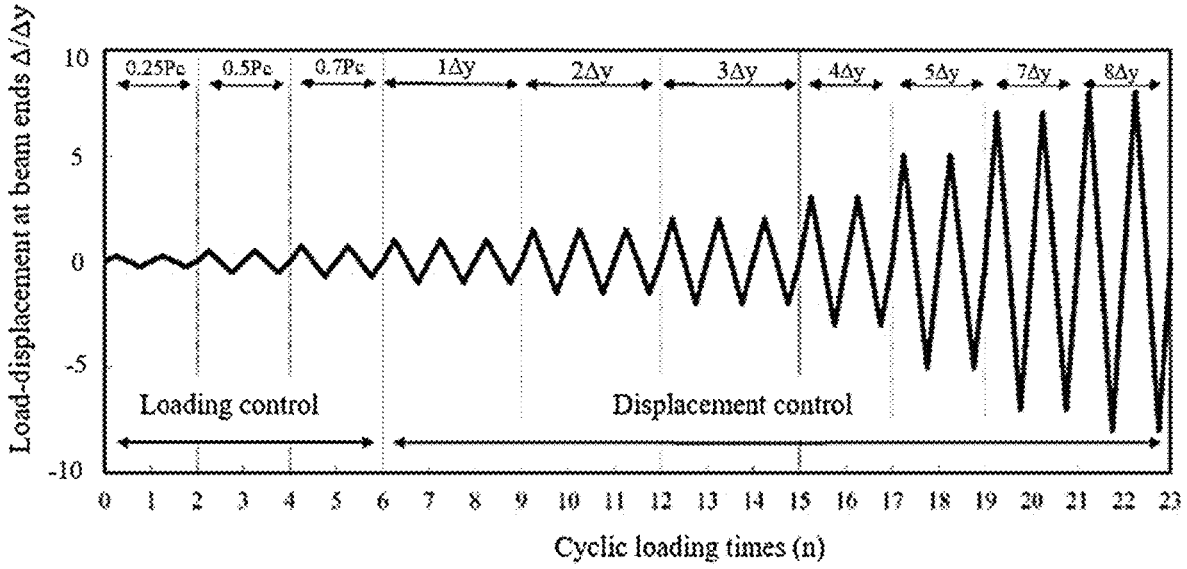
FIG. 8 illustrates a schematic diagram of a loading system of a full-scale test.

The full-scale specimens are tested by load-displacement control, with mechanical testing and simulation (MTS) actuator pushing out as forward loading and pulling back as reverse loading. A loading method of the tests is as follows: axial compression is applied vertically at tops of columns, and the axial compression is kept unchanged during loading; the MTS actuator is used to apply horizontal cyclic loading to tops of beams of the full-scale specimens. A loading system follows the requirements of "Specification for seismic test of building" JGJ101-2015, and the cyclic loading is carried out by a loading method of loading control followed by displacement control. In a first stage of loading control, loads are applied in increments of 0.25 Pmax, 0.5 Pmax, 0.7 Pmax, and the Pmax represents calculated bearing capacity of the beams until the specimens yield. After the specimens reach their yield strength, the displacement control is used, and the loads are applied in increments of 1.0Δy, 2.0Δy, 3.0Δy, and the Δy represents yield displacement of the specimens, referring to FIG. 8.

Main measurement contents of the tests include: horizontal loads and displacement at the tops of the columns, strain of longitudinal rebars and strain of stirrups in core areas of joints, concrete strain in joints areas, shear deformation in the core areas, width and distribution of cracks, etc. The loading system with the MTS actuator automatically collects and acquires hysteresis curves of horizontal load-displacement of ends of columns of the specimens, and a data collector automatically records development of strain of rebars and the concrete during loading, as well as displacements of key measuring points.

Damage Process:

Shear damage of the core areas occurs in all the specimens, the damage process of the specimen PCDJ is similar to that of the specimen RCJ. Although constructional form of each specimen is different, cracking process and damage characteristics of the core areas are basically similar, and all the specimens experience four stages of initial cracking, transfixion cracking, limit and damage, and the specimen PCDJ is used as an example to introduce the damage process:

1. At an early stage of loading, the strain of the longitudinal rebars and the concrete in the core areas of the joints is linear, and the joints are basically in an elastic working state. During loading, first flexural cracks appear at the beams, and with an increase of load-displacement, flexural cracks at the ends of the beams gradually increase, width of the flexural cracks gradually increases, and shear diagonal cracks appear in the core areas of the joints with width of 0.05 mm.

2. After the initial cracking, multiple flexural cracks at the ends of the beams become transfixion, and cracks development is basically completed. Under the cyclic loading, a pair of main diagonal cracks with an "X" shape are gradually formed in the core areas of the joints, and maximum width of the main diagonal cracks is 0.35 mm.

3. As the loads continue to increase after the transfixion cracking, and the crack development at the ends of the beams basically stops, at this point, two diagonal cracks intersect with the main diagonal cracks in the core areas of the joints, and the core areas are divided into a rhombus shape and multiple triangles, and development of the two diagonal cracks is significant, width increases sharply, and concrete near the main diagonal cracks spalls off continuously.

4. Under the cyclic loading, concrete in the core areas of the joints spalls off, the shear deformation increases sharply, and the bearing capacity decreases. At a late stage of loading, stirrups in the core areas of the joints, the closed stirrups 1 and the beam surface closed stirrups 2-2, are exposed, more obvious bond slip occurs in the beam surface longitudinal rebars 2-1, "pinch" phenomenon of the hysteresis curves is obvious.

Figure 9A:
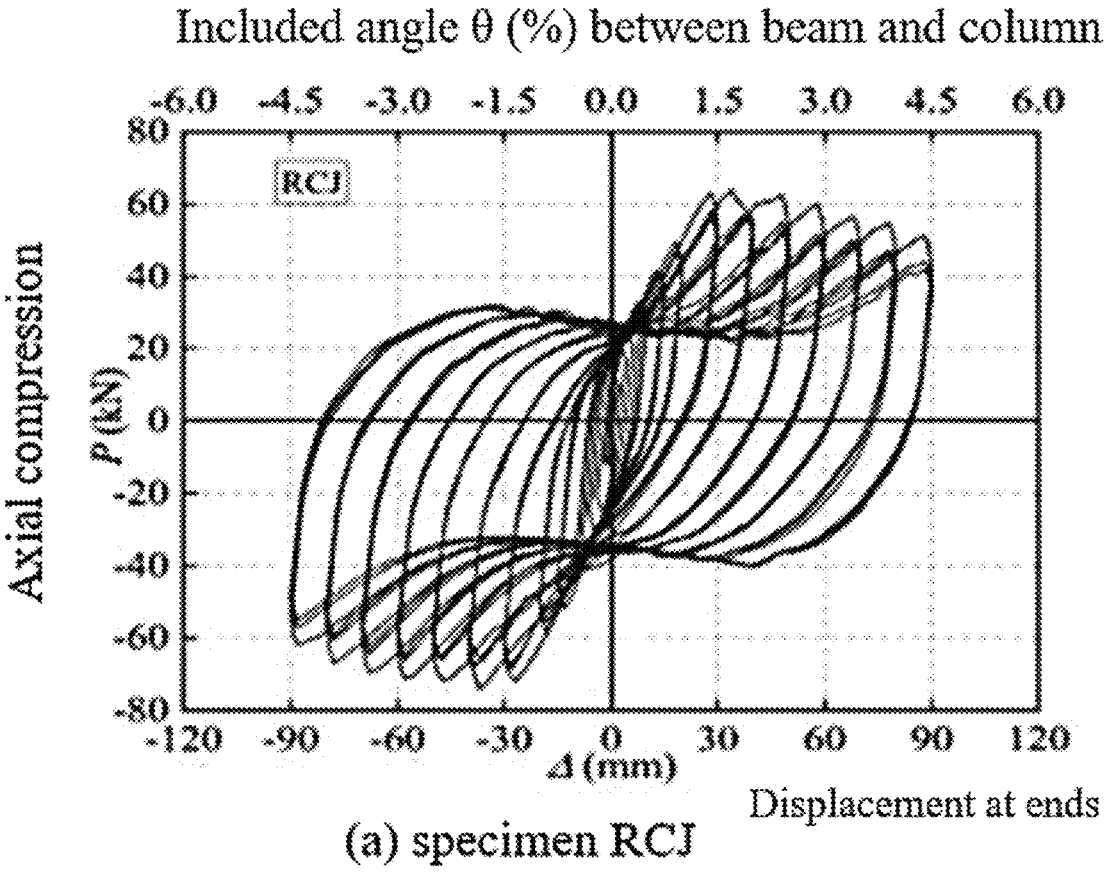
FIG. 9A illustrates a schematic diagram of hysteresis curves of load-displacement of a specimen RCJ.
Figure 9B:
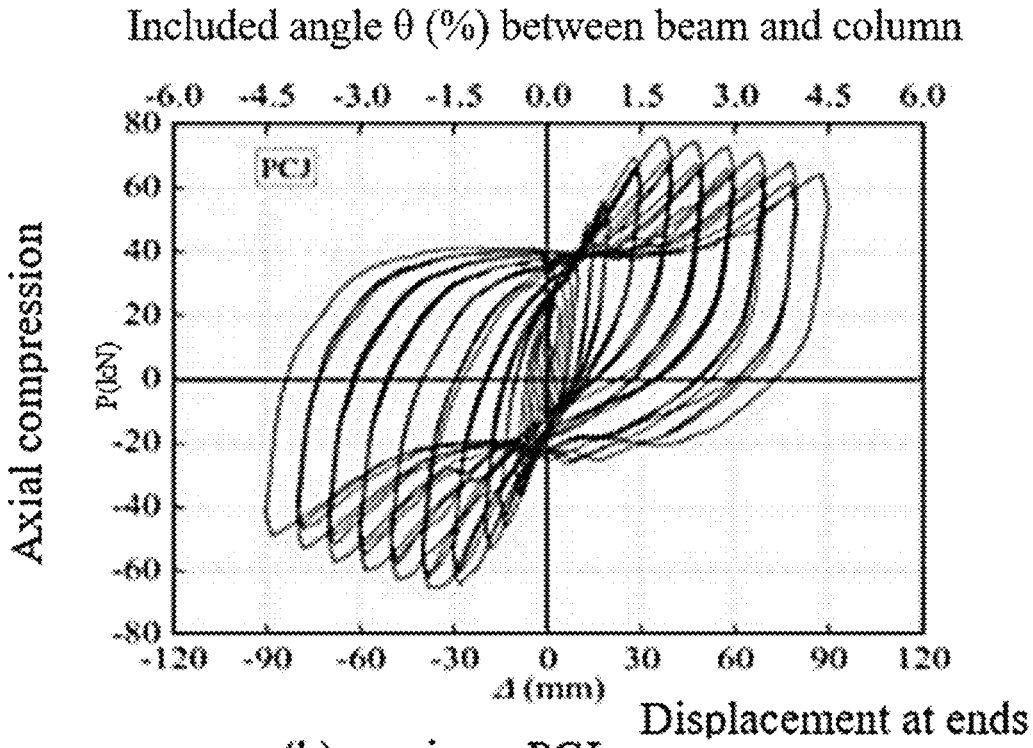
FIG. 9B illustrates a schematic diagram of hysteresis curves of load-displacement of a specimen PCJ.
Figure 9C:
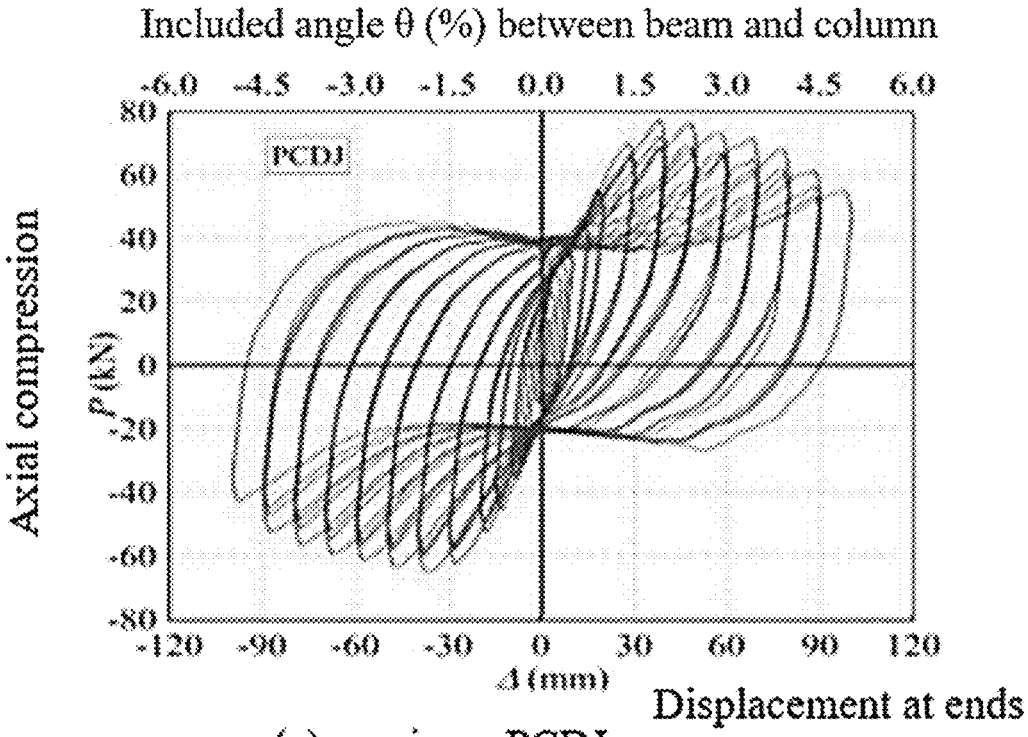
FIG. 9C illustrates a schematic diagram of hysteresis curves of load-displacement of a specimen PCDJ.

The Hysteresis Curves:

The hysteresis curves of horizontal load-displacement at the tops of the columns in the specimens are shown in FIG. 9A, FIG. 9B and FIG. 9C, and P represents loads at the ends of the beams and Δ represents displacement at the ends of the columns. Referring to the FIG. 9A, FIG. 9B and FIG. 9C:

1. At the early stage of loading, the load-displacement curves of the specimens are linear elastic, the deformation residual is small, and no crack is in the core areas of the joints; with an increase of the load-displacement, cracks appear in frame beams, and at this time, the hysteresis curves become nonlinear; the hysteresis curves showed an obvious "pinch" phenomenon after a further increase of the load-displacement, and the shear damage of the core areas and bond damage of the beam surface longitudinal rebars 2-1 occur in members.

2. The bearing capacity of the specimen PCDJ is basically equivalent to that of the specimen PCJ, and difference in the bearing capacity with the specimen RCJ is not significant.

3. According to the hysteresis curves of the specimen PCDJ, hysteresis rings start to pinch after the load-displacement reaches 40 mm, and the specimen PCDJ are damaged when the load-displacement reaches 100 mm. Compared with the specimen PCJ, ductility and energy consumption performance of the specimen PCDJ are comparable.

Figure 10:
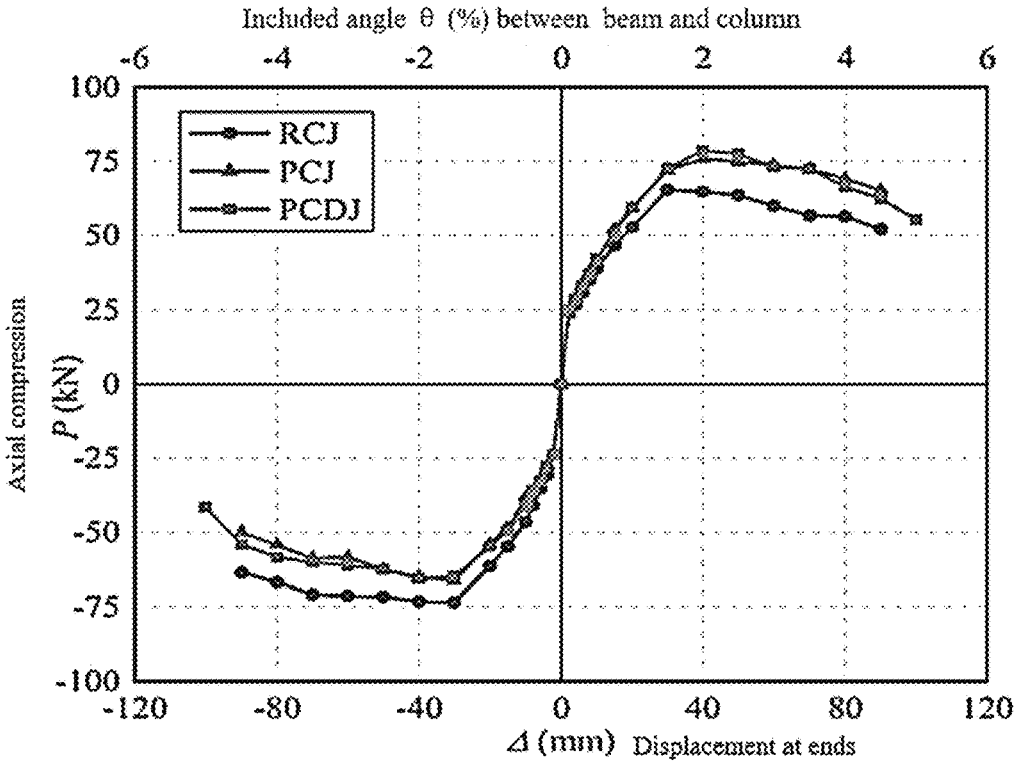
FIG. 10 illustrates a schematic comparison diagram of skeleton curves of specimens.

Skeleton Curves:

The skeleton curves of each specimen are shown in FIG. 10:

1. At the early stage of loading, the skeleton curves of all three specimens basically coincide, indicating that the specimen PCJ, the specimen PCDJ and the specimen RCJ have similar initial stiffness and member properties.

2. Under the forward loading, ultimate bearing capacity of the specimen PCDJ is slightly higher than that of the specimen PCJ; in an early stage of the reverse loading, the bearing capacity of the specimen PCDJ and the specimen PCJ is comparable, and in a late stage of the reverse loading, in which after horizontal displacement of the ends of the columns reaches-50 mm, the bearing capacity of the specimen PCDJ is slightly higher than that of the specimen PCJ.

3. With increasing displacement of the tops of the columns, stiffness of the specimen PCDJ gradually decreases, but the specimen PCDJ has a stable post-yield stiffness, indicating that joints similar to the specimen PCDJ have better seismic performance.

4. There is a certain difference in the bearing capacity of the specimen RCJ in forward and reverse directions, a reason of the certain difference may be a certain geometric deviation between a point of axial compression and section center of upper columns when the specimen RCJ is installed in place.

Figure 11:
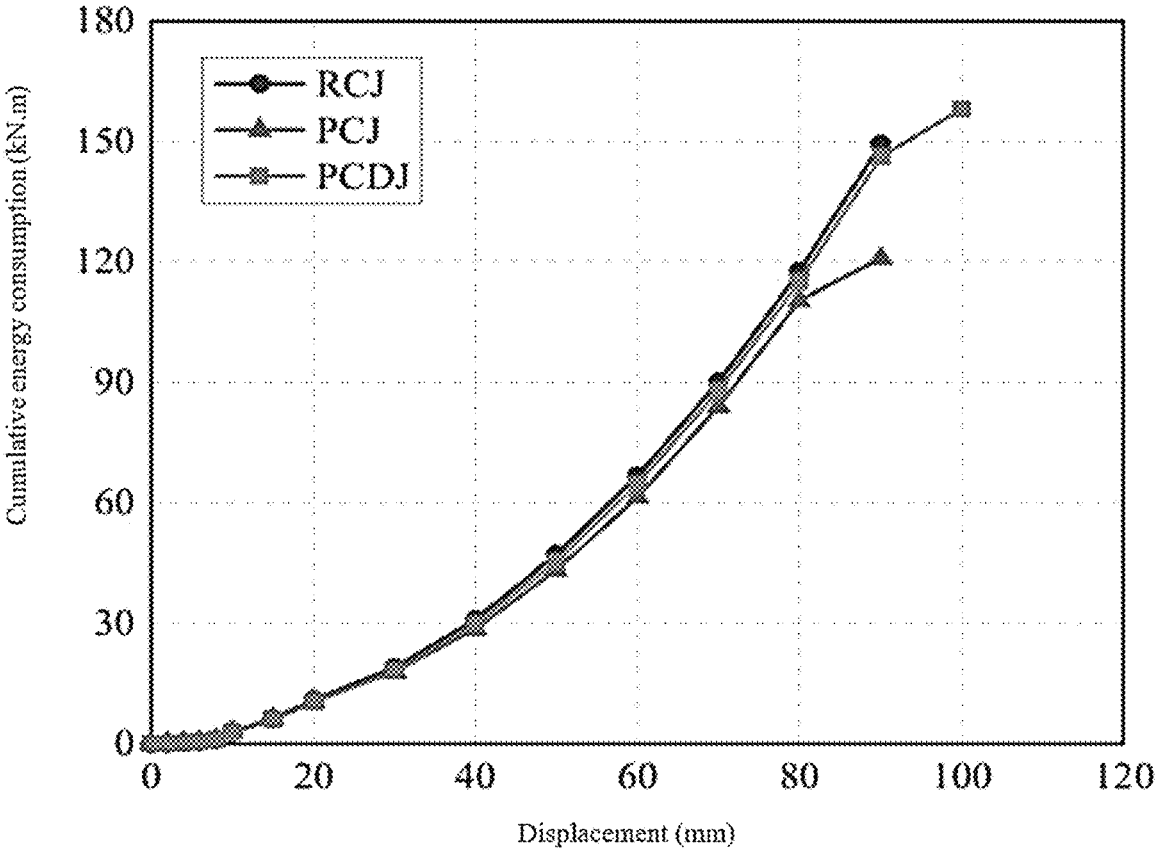
FIG. 11 illustrates a schematic diagram of cumulative energy consumption of specimens.

Joints Energy Consumption:

FIG. 11 illustrates cumulative energy consumption curves of each specimen:

1. At the early stage of loading, before concrete at the ends of the beams cracks, the specimens are in the elastic working stage, and cumulative energy consumption is small; with the increase of the load-displacement, damage of the concrete accumulates, and the cumulative energy consumption increases.

2. The cumulative energy consumption of the specimen PCJ is slightly lower than that of the specimen RCJ.

3. The cumulative energy consumption of the specimen PCDJ is higher than that of the specimen PCJ and similar to that of the specimen RCJ.

Based on above tests, the hysteresis curves, the skeleton curves, displacement ductility, energy consumption, the deformation capacity and the rebar strain in the core areas are studied by the low-frequency cyclic loading tests on the new prefabricated joints proposed in the disclosure, and following conclusions are obtained by analyzing the damage characteristics of the specimens:

1. Compared with the specimen PCJ, the specimen PCDJ has the bearing capacity, the displacement ductility, and the energy consumption improved to achieve "effects equivalent to cast-in-place".

2. The deformation capacity of the specimen PCDJ is basically equivalent to the deformation capacity of the specimen RCJ. Different configurations of the three specimens result in differences in deformation proportion of each member.

3. Damage of the core areas occurs in all the three specimens. Damage degree in the specimen PCDJ is lower than that in the specimen RCJ and the specimen PCJ. This is mainly due to that localized vertical non-transfixion cracks delay the damage of the core areas.

It should be noted that above is only an embodiment of the disclosure, and is not intended to limit the disclosure. Although the disclosure is described in detail with reference to the embodiments, those skilled in the art can still modify technical solutions recorded in the embodiments or make equivalent substitutions of some of technical features therein, and any modifications, equivalent substitutions, improvements, etc., which are made in accordance with spirit and principles of the disclosure shall be included in protection scope of the disclosure.

What is claimed is:

1. A reinforced concrete composite beam structure, comprising: precast concrete beam-slab integrated units, and a rebar cage; and each precast concrete beam-slab integrated unit comprising: a rib beam;

wherein each rib beam comprises: rebars, and stirrups in the rebars are closed stirrups;

wherein upper parts of the closed stirrups in each rib beam are extended from the rib beam to define a plurality of connecting rings connected to the rebar cage, a width of the plurality of connecting rings is gradually reduced from a bottom to a top to define rebar-placed areas outside the plurality of connecting rings, and a top of each connecting ring is bent to form a curved section;

wherein the rebar cage comprises: beam surface longitudinal rebars and beam surface closed stirrups connected to the beam surface longitudinal rebars;

wherein the rebar cage is disposed on upper parts of two of the rib beams connected to each other, the beam surface longitudinal rebars are disposed in the rebars-placed areas outside the plurality of connecting rings, two corresponding connecting rings of the plurality of connecting rings in the two rib beams are overlapped with a corresponding one of the beam surface closed stirrups in a staggered manner when the rebar cage is disposed on the two rib beams; and wherein the beam surface closed stirrups are lapped with the closed stirrups in a staggered manner to form the reinforced concrete composite beam structure with the rib beams after casting concrete;

wherein each closed stirrup is a continuous annular structure and in a right-angled trapezoidal shape; bottom sides of the closed stirrups of one of adjacent two of the precast concrete beam-slab integrated units are disposed facing towards bottom sides of the closed stirrups of the other one of the adjacent two precast concrete beam-slab integrated units: the rib beams of the adjacent two precast concrete beam-slab integrated units together define a groove; in each closed stirrup, a slant side and the bottom side of the closed stirrup are extended from the rib beam, passed through the groove and directedly connected with each other to define the connecting ring located outside the rib beam; and the beam surface closed stirrups are disposed in the groove and connected with the plurality of connecting rings, the beam surface longitudinal rebars are disposed in the rebars-placed areas outside the plurality of connecting rings, and there is no beam surface longitudinal rebar inside each connecting ring.

2. The reinforced concrete composite beam structure as claimed in claim 1, wherein the rebars comprise longitudinal rebars, and ones of the longitudinal rebars are disposed inside a corresponding one of the closed stirrups and connected to the corresponding closed stirrup.

3. The reinforced concrete composite beam structure as claimed in claim 2, wherein the rebars further comprise connecting hooks, two ends of each connecting hook are bent and connected to a corresponding one of the longitudinal rebars.

4. The reinforced concrete composite beam structure as claimed in claim 1, wherein each beam surface closed stirrup has a shape of an isosceles trapezoid with a top base longer than a bottom base.

5. The reinforced concrete composite beam structure as claimed in claim 4, wherein the bottom base of each beam surface closed stirrup is located in the groove and the top base of each beam surface closed stirrup is located outside the groove; and ones of the beam surface longitudinal rebars are located at the bottom base of each beam surface closed stirrup and outside the connecting rings, and other ones of the beam surface longitudinal rebars are located at the top base of each beam surface closed stirrup and outside the connecting rings.

6. The reinforced concrete composite beam structure as claimed in claim 1, wherein the rebars in each rib beam comprise: a plurality of longitudinal rebars, and the plurality of longitudinal rebars are located inside each closed stirrup; one of the plurality of longitudinal rebars is located at a connection between the slant side and a top side of each closed stirrup, another one of the plurality of longitudinal rebars is located at the bottom side of each closed stirrup and opposite to the one of the plurality of longitudinal rebars, another one of the plurality of longitudinal rebars is located at a connection between the slant side and a right-angle side of each closed stirrup, and another one of the plurality of longitudinal rebars is located at a connection between the right-angle side and the bottom side of each closed stirrup; and the rebars in each rib beam further comprise: a plurality of connecting hooks, two ends of one of the plurality of connecting hooks are bent and connected to the longitudinal rebar located at the connection between the right-angle side and the bottom side of the closed stirrup, two ends of another one of the plurality of connecting hooks are bent to connect the longitudinal rebar located at the connection between the slant side and the top side of the closed stirrup and connect the longitudinal rebar located at the bottom side of the closed stirrup.

7. A reinforced concrete composite beam structure, comprising: two precast concrete beam-slab integrated units and a rebar cage; wherein the two precast concrete beam-slab integrated units together define a groove, and the rebar cage is located in the groove;

wherein each precast concrete beam-slab integrated unit comprises: a rib beam provided with rebars and closed stirrups therein; each closed stirrup is a continuous annular structure and is in a right-angled trapezoidal shape, a slant side of each closed stirrup in the rib beam of each precast concrete beam-slab integrated unit is disposed facing towards a flat slab side of the precast concrete beam-slab integrated unit, and bottom sides of the closed stirrups in the rib beam of one of the two precast concrete beam-slab integrated units are disposed facing towards bottom sides of the closed stirrups in the rib beam of the other precast concrete beam-slab integrated unit;

wherein the slant side and the bottom side of each closed stirrup are extended from the rib beam and directedly connected with each other to define a connecting ring outside the rib beam and inside the groove, and the connecting ring is connected to the rebar cage;

wherein the rebar cage comprises: a plurality of beam surface longitudinal rebars and a plurality of beam surface closed stirrups; each beam surface closed stirrup is in a shape of isosceles trapezoid with a top base longer than a bottom base, and the bottom base of each beam surface closed stirrup is located in the groove and the top base of each beam surface closed stirrup is located outside the groove;

wherein the connecting rings of the closed stirrups of the one of the two precast concrete beam-slab integrated units are disposed corresponding to the connecting rings of the closed stirrups of the other precast concrete beam-slab integrated unit, respectively; each of the plurality of beam surface closed stirrups is overlapped with two corresponding connecting rings of the connecting rings of the two precast concrete beam-slab integrated units; and the plurality of beam surface longitudinal rebars are distributed inside each beam surface closed stirrup and located outside each connecting ring, and there is no beam surface longitudinal rebar inside the connecting rings of the closed stirrups of the two precast concrete beam-slab integrated units;

wherein the rebars in each rib beam comprise: a plurality of longitudinal rebars and a plurality of connecting hooks;

wherein the plurality of longitudinal rebars are located inside each closed stirrup; one of the plurality of longitudinal rebars is located at a connection between the slant side and a top side of each closed stirrup, another one of the plurality of longitudinal rebars is located at the bottom side of each closed stirrup and opposite to the one of the plurality of longitudinal rebars, another one of the plurality of longitudinal rebars is located at a connection between the slant side and a right-angle side of each closed stirrup, and another one of the plurality of longitudinal rebars is located at a connection between the right-angle side and the bottom side of each closed stirrup; and wherein two ends of one of the plurality of connecting hooks are bent to connect the longitudinal rebar located at the connection between the right-angle side and the bottom side of the closed stirrup, and two ends of another one of the plurality of connecting hooks are bent to connect the longitudinal rebar located at the connection between the slant side and the top side of the closed stirrup and the longitudinal rebar located at the bottom side of the closed stirrup.

* * * * *